US007328982B2

(12) United States Patent
Kusakari

(10) Patent No.: US 7,328,982 B2
(45) Date of Patent: Feb. 12, 2008

(54) LIQUID DROPLET DISCHARGE HEAD, LIQUID DROPLET DISCHARGE DEVICE, AND IMAGE FORMING APPARATUS

(75) Inventor: Tsutomu Kusakari, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 358 days.

(21) Appl. No.: 11/093,304

(22) Filed: Mar. 30, 2005

(65) Prior Publication Data

US 2005/0219338 A1 Oct. 6, 2005

(30) Foreign Application Priority Data

Mar. 31, 2004 (JP) ..... 2004-107852

(51) Int. Cl.
*B41J 2/45* (2006.01)
*B41J 2/04* (2006.01)

(52) U.S. Cl. ..... 347/68; 347/54

(58) Field of Classification Search ..... 347/54, 347/55, 63, 68, 70

See application file for complete search history.

(56) References Cited

U.S. PATENT DOCUMENTS

| | | | | | |
|---|---|---|---|---|---|
| 3,747,120 | A * | 7/1973 | Stemme | 347/70 |
| 4,023,180 | A * | 5/1977 | Zenner | 347/54 |
| 4,275,290 | A * | 6/1981 | Cielo et al. | 347/61 |
| 4,333,086 | A * | 6/1982 | Ebi | 347/55 |
| 4,432,003 | A * | 2/1984 | Barbero et al. | 347/55 |
| 4,494,128 | A | 1/1985 | Vaught | |
| 4,730,197 | A * | 3/1988 | Raman et al. | 347/40 |
| 4,937,597 | A * | 6/1990 | Yasuhara et al. | 347/71 |
| 5,072,242 | A | 12/1991 | Onhisi et al. | |
| 5,130,722 | A | 7/1992 | Onishi et al. | |
| 6,290,340 | B1 * | 9/2001 | Kitahara et al. | 347/70 |

FOREIGN PATENT DOCUMENTS

| | | |
|---|---|---|
| JP | 59-52664 A | 3/1984 |
| JP | 2-55143 A | 2/1990 |
| JP | 2-151446 A | 6/1990 |
| JP | 3-104650 A | 5/1991 |
| JP | 4-347647 A | 12/1992 |
| JP | 5-286135 A | 11/1993 |
| JP | 7-47676 A | 2/1995 |
| JP | 2001-150679 A | 6/2001 |
| JP | 2003-62997 A | 3/2003 |

* cited by examiner

*Primary Examiner*—Anh T. N. Vo
(74) *Attorney, Agent, or Firm*—Birch, Stewart, Kolasch & Birch, LLP

(57) ABSTRACT

The liquid droplet discharge head comprises: a liquid chamber flow channel which is filled with a liquid including an electrolytic liquid; a supply flow channel which branches from the liquid chamber flow channel; a pressure chamber which is connected to the supply flow channel and filled with the liquid supplied from the liquid chamber flow channel via the supply flow channel; a pressure generating device which is provided to correspond to the pressure chamber and pressurizes the liquid inside the pressure chamber; a nozzle which is connected to the pressure chamber and discharges a droplet of the liquid; and an electrolysis electrode which is formed on an inner wall of the nozzle in order to generate gas bubbles which reduce a flow channel resistance of the inner wall of the nozzle.

14 Claims, 15 Drawing Sheets

LIQUID DROPLET DISCHARGE HEAD, LIQUID DROPLET DISCHARGE DEVICE, AND IMAGE FORMING APPARATUS

BACKGROUND OF THE INVENTION

1. Field of the Invention

The present invention relates to a liquid droplet discharge head and an image forming apparatus, and more particularly, to a structure of a liquid droplet discharge head which discharges liquid droplets from nozzles by applying pressure to liquid by driving discharge energy generating devices (in other words, pressure generating devices), such as piezoelectric elements or heat generating elements, and an inkjet recording apparatus or other image forming apparatus using a liquid droplet discharge head of this kind.

2. Description of the Related Art

In the related art, an inkjet recording apparatus has been proposed in which a pair of electrodes are arranged inside an electrolysis chamber (pressure chamber) filled with an ink containing an electrolytic liquid, the ink being electrolyzed by applying a voltage to the pair of electrode in accordance with information to be recorded, and ink being discharged from a nozzle due to the increase in gas volume caused by the electrolysis (Japanese Patent Application Publication No. 3-104650).

Furthermore, Japanese Patent Application Publication No. 5-286135 discloses an inkjet recording apparatus having a structure in which nozzles are formed on the surface of a rotating drum, and proposes a composition in which ink is discharged from the nozzles by means of the pressure of gas generated by electrolysis of an electrolytic liquid between electrodes, and the centrifugal force of the rotating drum.

Moreover, Japanese Patent Application Publication No. 7-47676 discloses an inkjet recording head and a recording method for same, in which electrodes for electrolysis are arranged inside a common liquid chamber which supplies recording liquid to respective liquid flow channels, provided with a heater forming an energy generating device. By generating gas bubbles inside the common liquid chamber due to electrolysis, variation of the pressure inside the common liquid chamber is suppressed and variation in refilling time between different liquid flow channels is reduced.

Generally, in an inkjet system which uses volatile ink (including water-based inks) or ink that changes properties upon contact with the air, the ink solvent evaporates from the meniscus surface of the nozzles, or the ink changes characteristics, during a normal discharge operation or when the apparatus is at rest (in a non-printing mode), thus leading to variation in properties such as the ink viscosity. Therefore, discharge errors are liable to occur.

Japanese Patent Application Publication Nos. 3-104650, 5-286135 and 7-47676 do not provide any disclosure regarding countermeasures for discharge errors such as there.

SUMMARY OF THE INVENTION

The present invention has been contrived in view of the aforementioned circumstances, and an object thereof is to provide a liquid droplet discharge head and an image forming apparatus using same, whereby the occurrence of discharge errors can be prevented by enabling the discharge of liquid of increased viscosity.

In order to attain the aforementioned object, the present invention is directed to a liquid droplet discharge head, comprising: a liquid chamber flow channel which is filled with a liquid including an electrolytic liquid; a supply flow channel which branches from the liquid chamber flow channel; a pressure chamber which is connected to the supply flow channel and filled with the liquid supplied from the liquid chamber flow channel via the supply flow channel; a pressure generating device which is provided to correspond to the pressure chamber and pressurizes the liquid inside the pressure chamber; a nozzle which is connected to the pressure chamber and discharges a droplet of the liquid; and an electrolysis electrode which is formed on an inner wall of the nozzle in order to generate gas bubbles which reduce a flow channel resistance of the inner wall of the nozzle.

According to the present invention, the frictional resistance between the inner wall of the nozzle and the liquid is reduced by generating minute gas bubbles on the inner wall of the nozzle by electrolysis, and therefore it becomes easier to discharge the liquid. Accordingly, discharge of high-viscosity liquid becomes possible and prevention of discharge errors and restoration in the event of discharge errors also become possible.

Preferably, the liquid droplet discharge head further comprises another electrolysis electrode constituting a pair with the electrolysis electrode formed on the inner wall of the nozzle, the other electrolysis electrode being provided on one of an inner wall of the supply flow channel and an inner wall of the pressure chamber.

Various designs can be adopted for the positioning of the electrode of different polarity (second electrode) which forms a pair with the electrolysis electrode formed on the inner wall of the nozzle (first electrode), provided that it is formed on a surface of the flow channels inside the head which makes contact with the liquid. However, desirably, the second electrode is provided on the inner wall of the supply flow channel or the inner wall of the pressure chamber. By applying a voltage between the first electrode and the second electrode, the liquid is electrolyzed and gas bubbles are generated on the electrode surfaces. In parallel with the generation of gas bubbles, the pressure generating device is driven and a discharge operation is performed. If the second electrode is provided inside the pressure chamber, then desirably, it is disposed in a position where it is not liable to affect the discharge force created by the pressure generating device, in other words, a position as distant as possible from the nozzle (for example, a position on the far side from the nozzle with respect to the center line of the pressure chamber).

Preferably, the electrolysis electrode formed on the inner wall of the nozzle is split into a plurality of electrode sections in a circumferential direction of the nozzle, and a voltage is applied selectively to each of the respective electrode sections.

According to this mode, it is possible to obtain a desired distribution in the generation of gas bubbles with respect to the circumferential direction of the nozzles, by choosing the arrangement of the split electrode sections and selecting the electrode sections to which voltage is applied. The direction of flight of the liquid droplets can be controlled by means of the flow velocity distribution created by the distribution in the generation gas bubbles.

In order to attain the aforementioned object, the present invention is also directed to a liquid droplet discharge device, comprising: the above-described liquid droplet discharge head; a discharge control device which controls a driving of the pressure generating device; and an electrolysis signal generating device which generates a voltage signal for application to the electrolysis electrode.

Desirably, the application of voltage to the electrolysis electrodes is controlled in harmony with the discharge operation. Various control modes are possible: for instance, a mode in which gas bubbles are generated on the inner walls of the nozzle (at all times) during a normal discharge operation; a mode which switches between generation of gas bubbles and non-generation of gas bubbles, according to requirements, during a discharge operation; a mode in which gas bubbles are formed during a restoring operation (preliminary discharge); a mode in which preliminary discharge is carried out by generating gas bubbles when a discharge error has been detected by the discharge determination device; and the like.

If a composition is adopted which allows switching between a case where discharge is carried out in a state where gas bubbles are generated on the inner wall of the nozzle, and a case where discharge is carried out without generating gas bubbles, then the apparent nozzle diameter will vary depending on whether or not gas bubbles are generated. Therefore, desirably, the driving of the pressure generating device is controlled in such a manner that there is no variation in the discharge volume depending on the generation or non-generation of gas bubbles, and hence the discharge volume is kept as a uniform level (namely, the variation in the discharge volume is kept within a prescribed range).

Furthermore, it is also possible to use the drive power source of the pressure generating device (the actuator, heater, or the like), jointly, as a power source for generating the electrolysis voltage.

Preferably, the electrolysis signal generating device generates a voltage signal whereby a diameter of the gas bubbles formed on the inner wall of the nozzle is not more than 10 μm.

Gas bubbles having a diameter of 10 μm or less disappear by dissolving into the liquid within several seconds to several tens seconds, at the most, and therefore, they do not adversely affect the discharge operation. Furthermore, there is little decline in the discharge cycle caused by waiting for the gas bubbles to disappear, and therefore, productivity can be maintained.

In order to attain the aforementioned object, the present invention is also directed to a liquid droplet discharge head, comprising: a liquid chamber flow channel which is filled with a liquid including an electrolytic liquid; a supply flow channel which branches from the liquid chamber flow channel; a pressure chamber which is connected to the supply flow channel and filled with the liquid supplied from the liquid chamber flow channel via the supply flow channel; a pressure generating device which is provided to correspond to the pressure chamber and pressurizes the liquid inside the pressure chamber; a nozzle which is connected to the pressure chamber and discharges a droplet of the liquid; and an electrolysis electrode which is formed on an inner wall of a restricting section of the supply flow channel in order to generate gas bubbles which impede a liquid flow on the inner wall of the restricting section of the supply flow channel.

According to the present invention, by generating a relatively large gas bubble by means of electrolysis on the inner wall of a restricting section (the point of maximum constriction) in the supply flow channel linking the liquid chamber flow channel with the pressure chambers, movement of the liquid toward the supply flow channel side (in other words, reflux) during a discharge operation is suppressed by the surface tension at the boundary between the gas bubble and the liquid. Consequently, it is possible to increase the flow in the discharge direction and thereby raise the discharge force. More specifically, discharge of high-viscosity liquid becomes possible and prevention of discharge errors and restoration in the event of discharge errors also become possible.

Preferably, the liquid droplet discharge head further comprises another electrolysis electrode constituting a pair with the electrolysis electrode formed on the inner wall of the restricting section of the supply flow channel, the other electrolysis electrode being provided on one of an inner wall of another portion of the supply flow channel and an inner wall of the pressure chamber.

Various designs can be adopted with respect to the positioning of the electrode of different polarity which forms a pair with the electrolysis electrode formed on the inner wall of the restricting section of the supply flow channel. However, desirably, the electrode is provided on the inner wall of another portion of the supply flow channel or the inner wall of the pressure chamber.

Preferably, a plurality of supply flow channels are formed with respect to one pressure chamber, and the electrolysis electrode for generating gas bubbles which impede the flow of liquid is provided on the inner wall of at least one of the plurality of supply flow channels.

By generating a gas bubble for impeding reflux, selectively, in a plurality of supply flow channels, it is possible to control the reflux volume of the liquid during discharge.

Preferably, an electrolysis electrode which is formed on an inner wall of the nozzle in order to generate gas bubbles which reduce a flow channel resistance of the inner wall of the nozzle.

According to this mode, the frictional resistance between the inner wall of the nozzle and the liquid is reduced by generating minute gas bubbles on the inner wall of the nozzle by electrolysis, and therefore it becomes easier to discharge the liquid. Thereby, in combination with the reflux impeding function in the supply flow channel, it is possible to achieve an ever greater improvement in discharge efficiency.

In order to attain the aforementioned object, the present invention is also directed to a liquid droplet discharge device, comprising: the above-described liquid droplet discharge head; a discharge control device which controls a driving of the pressure generating device; and an electrolysis signal generating device which generates a voltage signal for application to the electrolysis electrode.

By generating a gas bubble for impeding reflux in the supply flow channel of the pressure chamber during a discharge operation caused by driving the pressure generating device, it is possible to improve the discharge force.

Preferably, the electrolysis signal generating device generates a voltage signal for generating the gas bubbles which close the restricting section of the supply flow channel.

By sealing the restricting section of the supply flow channel completely, by means of the gas bubble generated by electrolysis, it is possible reliably to prevent reflux to the liquid chamber flow channel side, and therefore, the discharge pressure can be maintained.

In order to attain the aforementioned object, the present invention is also directed to a liquid droplet discharge device, comprising: the above-described liquid droplet discharge head; a discharge control device which controls a driving of the pressure generating device; an electrolysis signal generating device which generates a first voltage signal applied to the electrolysis electrode formed on the inner wall of the nozzle and a second voltage signal applied to the electrolysis electrode formed on the inner wall of the restricting section of the supply flow channel; and a switching device which applies each of the first voltage signal and the second voltage signal generated by the electrolysis signal generating device selectively to a corresponding one of the electrolysis electrodes.

If a composition is adopted in which electrolysis electrodes are arranged on the inner wall of the nozzle and the inner wall of the restricting section of the supply flow channel, then it is desirable to use an electrolysis signal generating device capable of generating a first voltage signal suitable for generation of gas bubbles on the inner wall of the nozzle and a second voltage signal suitable for generation of a gas bubble in the restricting section of the supply flow channel, voltage being applied to the respective electrodes selectively, by means of a switching device.

In order to attain the aforementioned object, the present invention is also directed to an image forming apparatus, comprising: the above-described liquid droplet discharge device, wherein an image is formed on a recording medium by means of liquid droplets discharged from the nozzles.

For example, the liquid droplet discharge head used in this image forming apparatus achieves a prescribed dot arrangement by causing liquid droplets to be discharged from the liquid droplet discharge openings (nozzles) by controlling the pressure generating devices (actuators, bubble-generating heaters, or the like) on the basis of image data.

A compositional example of a liquid droplet discharge head is a full line type inkjet head having a nozzle row in which a plurality of nozzles for discharging ink are arranged through a length corresponding to the full width of the recording medium.

In this case, a mode may be adopted in which a plurality of relatively short discharge head blocks having nozzles rows which do not reach a length corresponding to the full width of the recording medium are combined and joined together, thereby forming nozzle rows that correspond to the full width of the recording medium.

A "full-line recording head" is normally disposed along the direction perpendicular to the relative delivering direction of the printing medium (the conveyance direction), but also possible is an aspect in which the recording head is disposed along the diagonal direction given a predetermined angle with respect to the direction perpendicular to the conveyance direction. The arrangement of the image-recording elements in the recording head is not limited to a single row array in the form of a line, but a matrix array composed of a plurality of rows is also possible. Furthermore, also possible is an aspect in which a plurality of short-length recording head units having a row of image-recording elements that do not have lengths that correspond to the entire width of the printing medium are combined and the image-recording element rows are configured so as to correspond to the entire width of the printing medium, with these units acting as a whole.

The "printing medium" is a medium (an object that may be referred to as an image formation medium, recording medium, recorded medium, image receiving medium, or the like) that receives the printing of the recording head, and includes continuous paper, cut paper, seal paper, resin sheets such as sheets used for overhead projectors (OHP), film, cloth, and various other media without regard to materials or shapes.

The term "conveying device" includes an aspect in which the printing medium is conveyed with respect to a stopped (fixed) recording head, an aspect in which the recording head is moved with respect to a stopped printing medium, or an aspect in which both the recording head and the printing medium are moved.

According to the present invention, since an electrolysis electrode is formed on the inner wall of the nozzle, in such a manner that gas bubbles can be generated on the inner wall of the nozzle by means of electrolysis, then the frictional resistance between the inner wall of the nozzle and the liquid is reduced and it becomes easier to discharge the liquid. Accordingly, discharge of high-viscosity liquid becomes possible and prevention of discharge errors and restoration in the event of discharge errors also become possible.

Furthermore, according to another mode of the present invention, since an electrolysis electrode is formed on the inner wall of a restricting section of the supply flow channel which links the liquid chamber flow channel with the pressure chamber, in such a manner that a gas bubble that impedes reflux of the liquid toward the liquid chamber flow channel is generated in the restricting section of the supply flow channel by means of electrolysis, then it is possible to reduce the pressure loss toward to the liquid chamber flow channel during discharge, and hence discharge pressure can be sustained. Accordingly, discharge of high-viscosity liquid becomes possible and prevention of discharge errors and restoration in the event of discharge errors also become possible.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
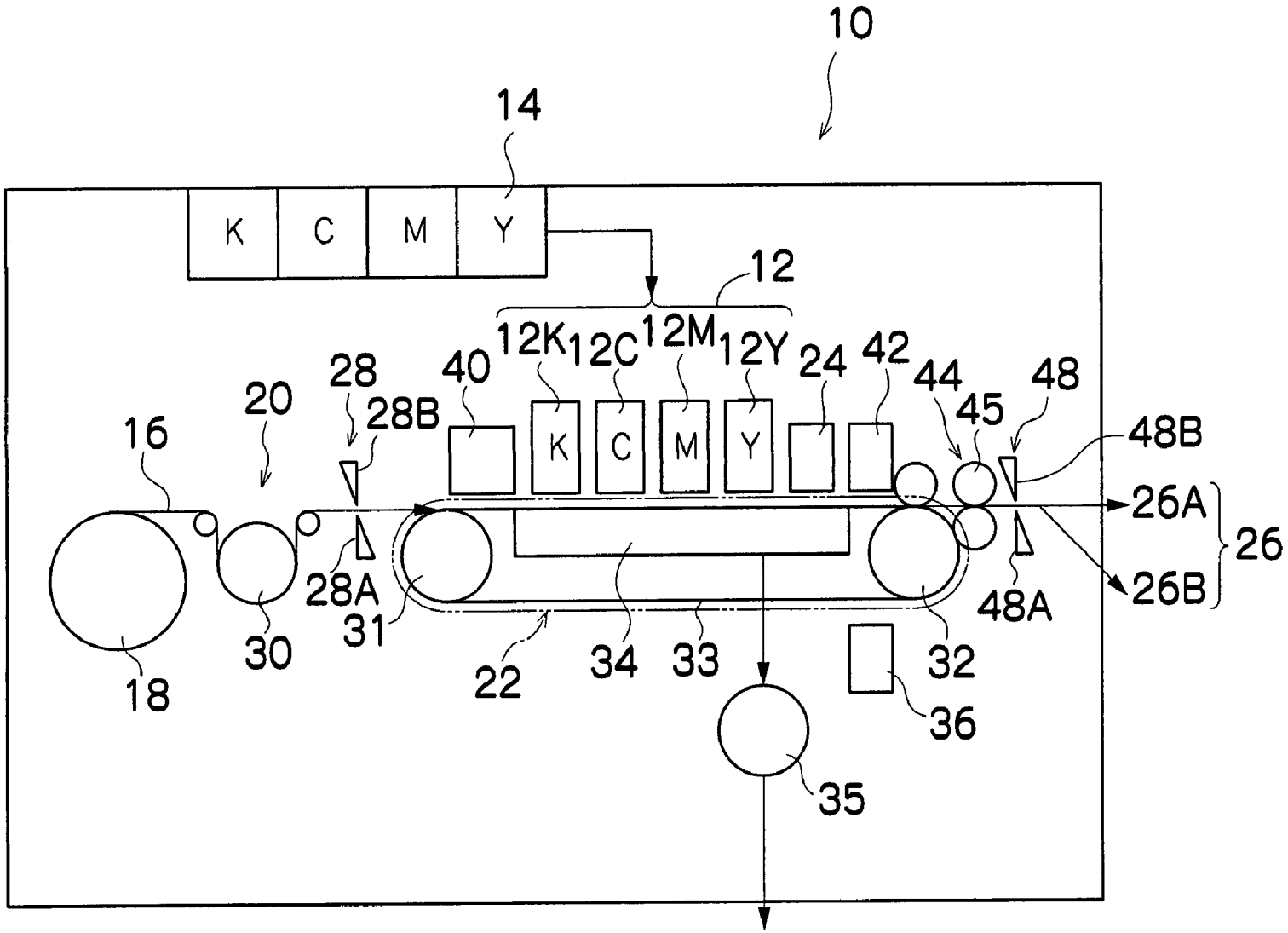
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

The ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, but shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
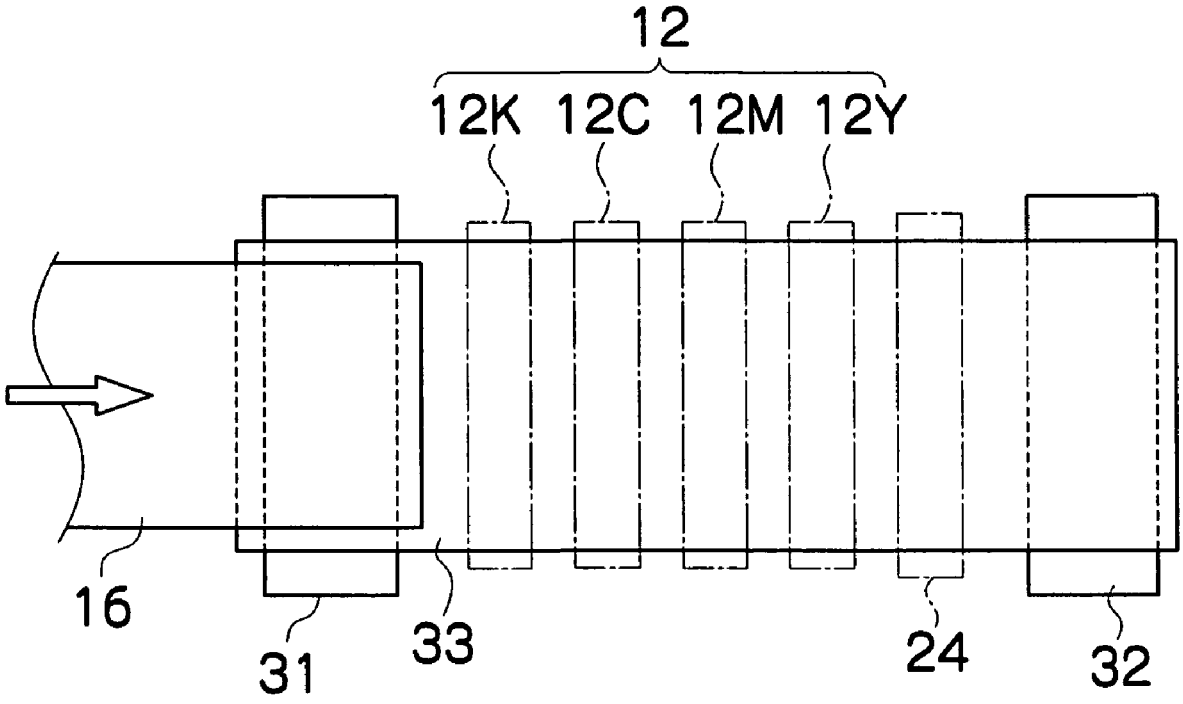
FIG. 2 is a plan view of principal components of an area around a printing unit of the inkjet recording apparatus in FIG. 1.

Each of the print heads 12K, 12C, 12M, and 12Y of the printing unit 12 is composed of a so-called full-line head having a length that corresponds to the maximum paper width intended for use in the inkjet recording apparatus 10, in which a plurality of ink-droplet ejection apertures (nozzles) are arranged along a length that exceeds at least one side of the maximum-size recording paper 16 (i.e. along the entire width of the printable area in the recording paper 16) as shown in FIG. 2.

The print heads 12K, 12C, 12M, and 12Y are arranged in this order from the upstream side along the direction substantially perpendicular to the delivering direction of the recording paper 16 (hereinafter referred to as the paper conveyance direction).

A color print can be formed on the recording paper 16 by ejecting the inks from the print heads 12K, 12C, 12M, and 12Y, respectively, onto the recording paper 16 while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors. In addition, the arrangement order of the print heads 12K, 12C, 12M, and 12Y is not limited to those.

The print determination unit 24 has an image sensor for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position. The details of the ejection determination are described later.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively.

When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Structure of Print Head

Next, the structure of the print heads is described. The print heads 12K, 12C, 12M, and 12Y provided for the ink colors have the same structure, and a reference numeral 50 is hereinafter designated to any of the print heads 12K, 12C, 12M, and 12Y.

Figure 3A:
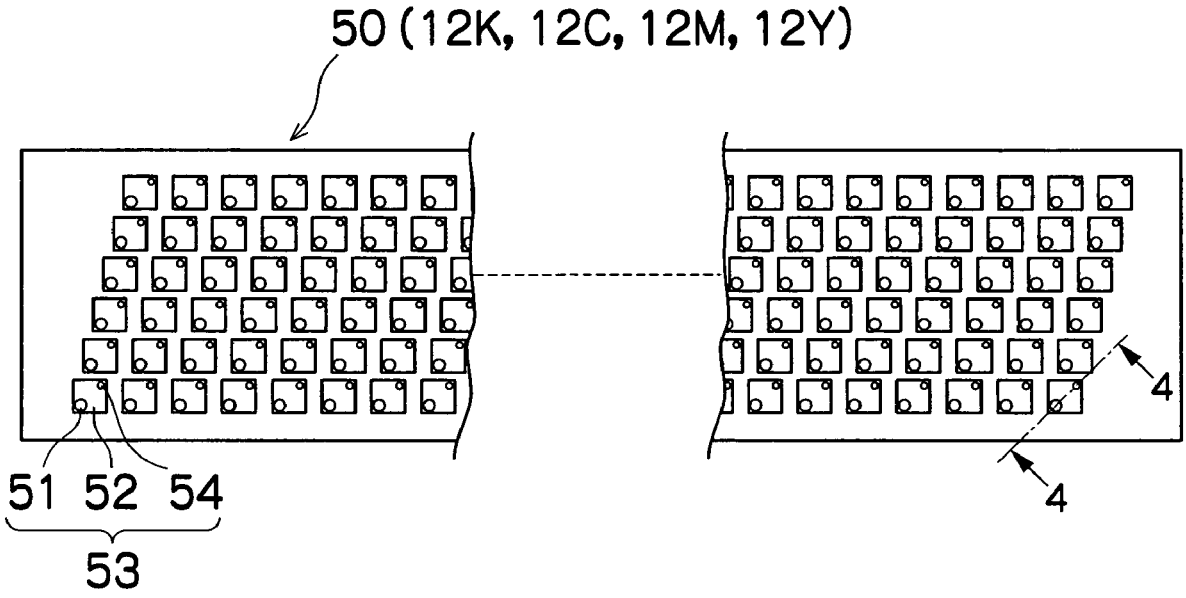
FIG. 3A is a perspective plan view showing an example of a configuration of a print head.
Figure 3B:
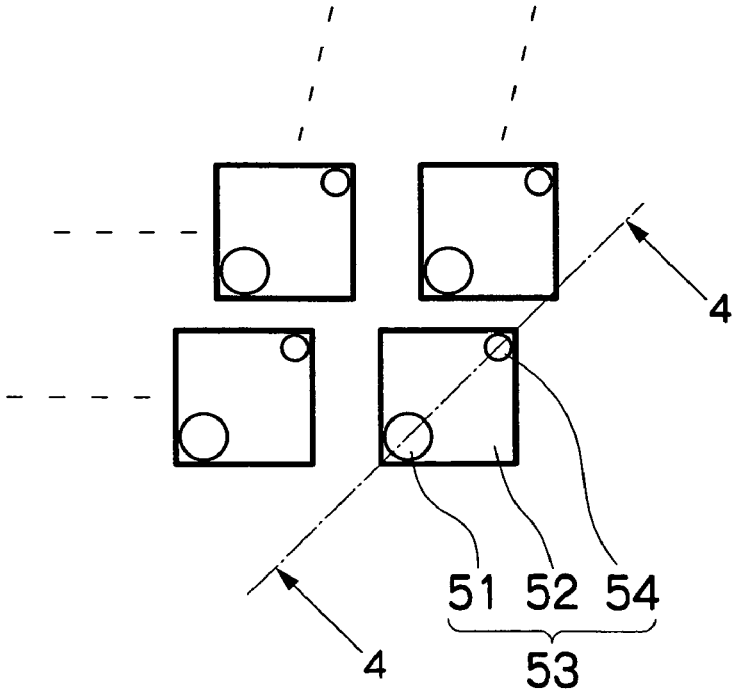
FIG. 3B is a partial enlarged view of FIG. 3A.
Figure 3C:
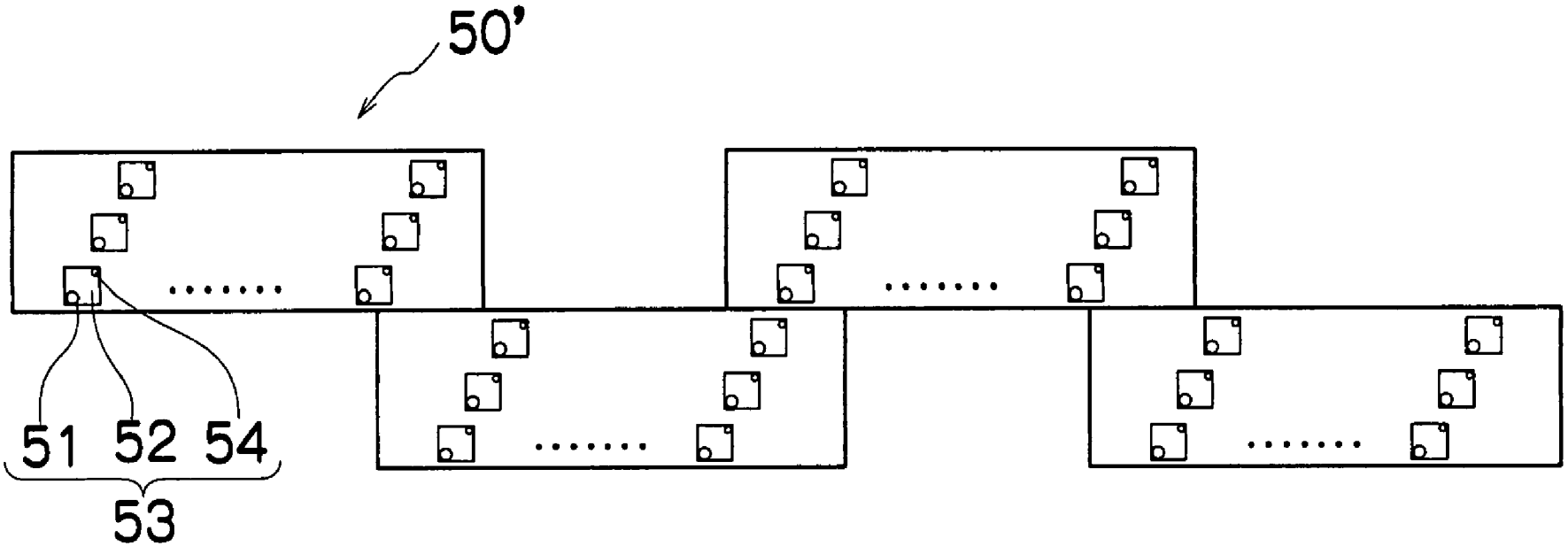
Figure 4:
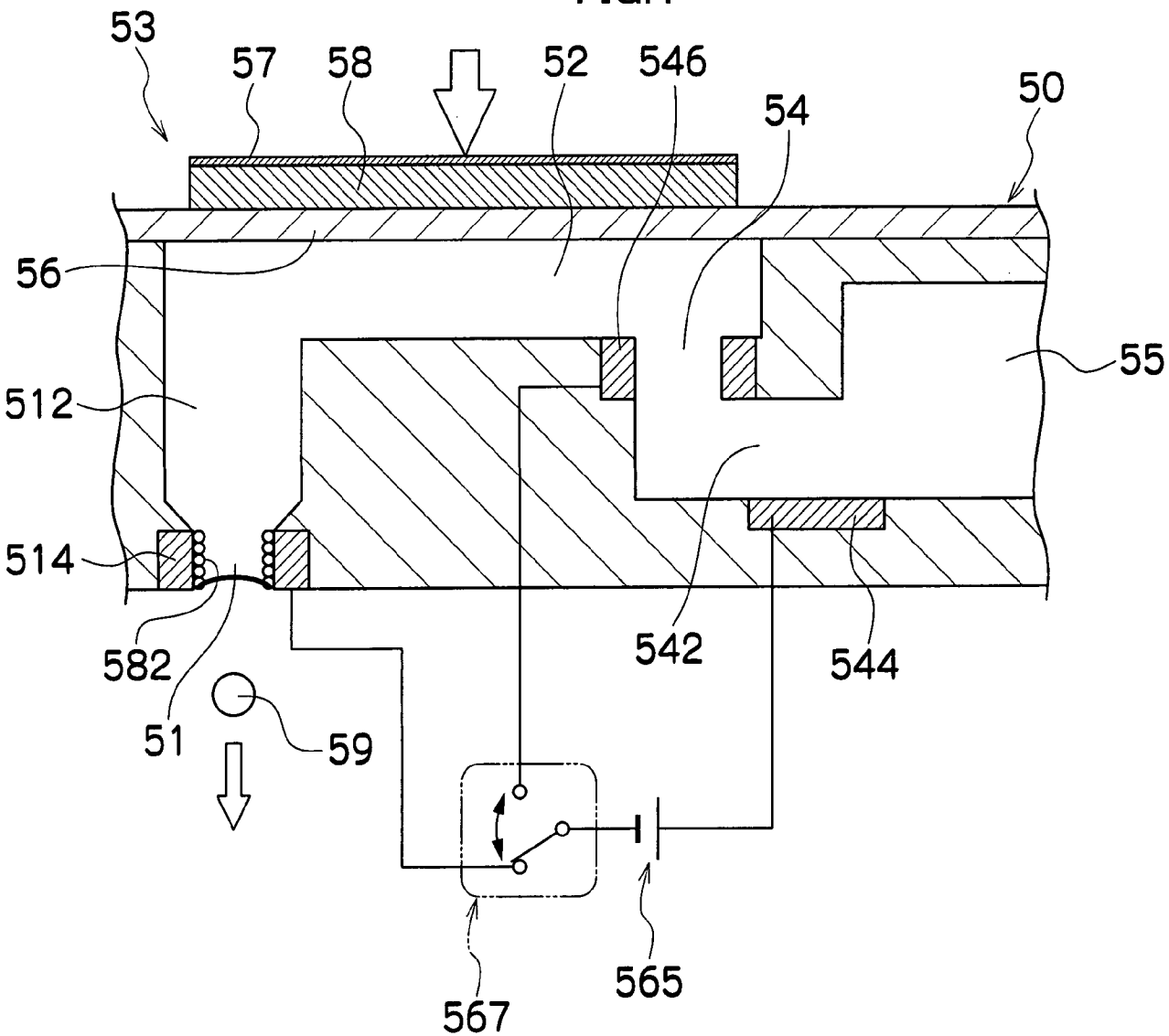
FIG. 4 is a cross-sectional view along a line 4-4 in FIGS. 3A and 3B.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 4-4 in FIGS. 3A and 3B, showing the inner structure of an ink chamber unit.

The nozzle pitch in the print head 50 should be minimized in order to maximize the density of the dots printed on the surface of the recording paper. As shown in FIGS. 3A, 3B, 3C and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

The print head 50 in the present embodiment is not limited to a configuration in which one or more nozzle rows in which the ink discharging nozzles 51 are arranged along a length corresponding to the entire width of the recording paper 16 in the direction substantially perpendicular to the paper conveyance direction. Alternatively, as shown in FIG. 3B, a full-line head can be composed of a plurality of short two-dimensionally arrayed head units 50' arranged in the form of a staggered matrix and combined so as to form nozzle rows having lengths that correspond to the entire width of the recording paper 16.

As shown in FIGS. 3A and 3B, the planar shape of the pressure chamber 52 provided for each nozzle 51 is substantially a square, and an outlet to the nozzle 51 and an inlet for supplied ink (supply port) 54 are disposed in both corners on a diagonal line of the square. The shape of the pressure chamber 52 is not limited to the present example, and the planar shape may one of various shapes, such as a quadrilateral shape (diamond, rectangle, or the like), another polygonal shape, such as a pentagon or hexagon, or a circular or elliptical shape.

As shown in FIG. 4, each pressure chamber 52 is respectively connected to a nozzle 51 which forms a final discharge port, via a nozzle connection passage 512. In other words, here, the nozzle 51 is a discharge port tube section which forms the final restricted section from which the liquid is discharged. Desirably, the nozzle size is designed to a diameter of approximately several tens μm (for example, 30 μm), and to a length of several tens μm.

Moreover, the pressure chambers 52 are connected to a common flow channel 55 via individual supply flow channels 542 which branch from the common flow channel 55 (which corresponds to the liquid chamber flow channel). The common flow channel 55 is connected to an ink tank (not shown in FIG. 4, but indicated by reference numeral 60 in FIG. 6), which is a base tank that supplies ink, and the ink supplied from the ink tank 60 is delivered through the common flow channel 55 in FIG. 4 to the pressure chambers 52.

An actuator 58 provided with an individual electrode 57 is bonded to a pressure plate 56 (a diaphragm that also serves as a common electrode) which forms the ceiling of the pressure chamber 52. When a drive voltage is applied to the individual electrode 57, then the actuator 58 deforms, thereby changing the volume of the pressure chamber 52. This causes a pressure change which results in an ink droplet 59 being discharged from the nozzle 51. A piezoelectric body, such as a piezo element, is suitable as the actuator 58. When ink is discharged, new ink is supplied to the pressure chamber 52 from the common flow channel 55 through the supply port 54.

As shown in FIG. 4, in the head 50 according to this example, a first electrolysis electrode (hereafter, called the "first electrode") 514 is formed on the inner wall of the nozzle 51, and a second electrolysis electrode 2 (hereafter, called the "second electrode") 544 is formed on the inner wall of the supply flow channel 542. Furthermore, a third electrolysis electrode (hereafter, called "third electrode") 546 is formed on the inner wall of the restricting section of the supply flow channel 542 (the section where the cross-sectional area of the flow channel is a minimum, which is in the vicinity of the supply port indicated by reference numeral 54 in the example shown in FIG. 4). The electrodes (514, 544 and 546) desirably have a treatment layer which has been processed to provide ink resistance.

A pair of electrodes (hereafter, called the "first electrode pair") is formed by the first electrode 514 and the second electrode 544, and a pair of electrodes (hereafter, called the "second electrode pair") is formed by the third electrode 546 and the second electrode 544. More specifically, the second electrode 544 is connected to the positive pole of a variable output power supply unit 565 (indicated by a battery symbol in FIG. 4), and the first electrode 514 and the third electrode 546 are connected the negative pole of the variable output power supply unit 565, via a selector switch 567.

By controlling the connection status of the selector switch 567, it is possible to apply a voltage selectively to the first electrode pair including the first electrode 514, or the second electrode pair including the third electrode 546.

For example, if a voltage is applied between the electrodes of the first electrode pair, then the ink inside the flow channel is electrolyzed, and hydrogen bubbles 582 are formed on the surface of the first electrode 514 (in other words, the inner wall of the nozzle 51). In this case, oxygen bubbles may form readily on the surface of the second electrode 544, but the amount of oxygen generated is smaller than the amount of hydrogen generated (logically, it is half the amount).

Furthermore, if the selector switch 567 is switched and a voltage is applied between the electrodes of the second electrode pair, then hydrogen bubbles form on the surface of the third electrode 546 (in other words, the inner walls of the supply flow channel 542) (these bubbles are not illustrated in FIG. 4). As described in detail below, it is possible to control the diameter of the bubbles generated, the volume of the bubbles, the time at which the bubbles disappear, and other factors, by controlling the applied voltage.

The head 50 having the structure illustrated in FIG. 4 may be manufactured by layering together and bonding a plurality of plate members created by forming holes or grooves in a thin plate member of stainless steel plate (SUS plate), silicon, or the like, by means of etching, pressing, micromachining, or other such techniques. Furthermore, FIG. 4 shows an example where the first electrode 514 is buried in the inner wall of the nozzle 51, but in implementing the present invention, it is also possible to make the nozzle plate in which the nozzles 51 are pierced out of an electrically conductive material, such as a metal, in such a manner that the nozzle plate can also serve as a first electrode 514.

Figure 5:
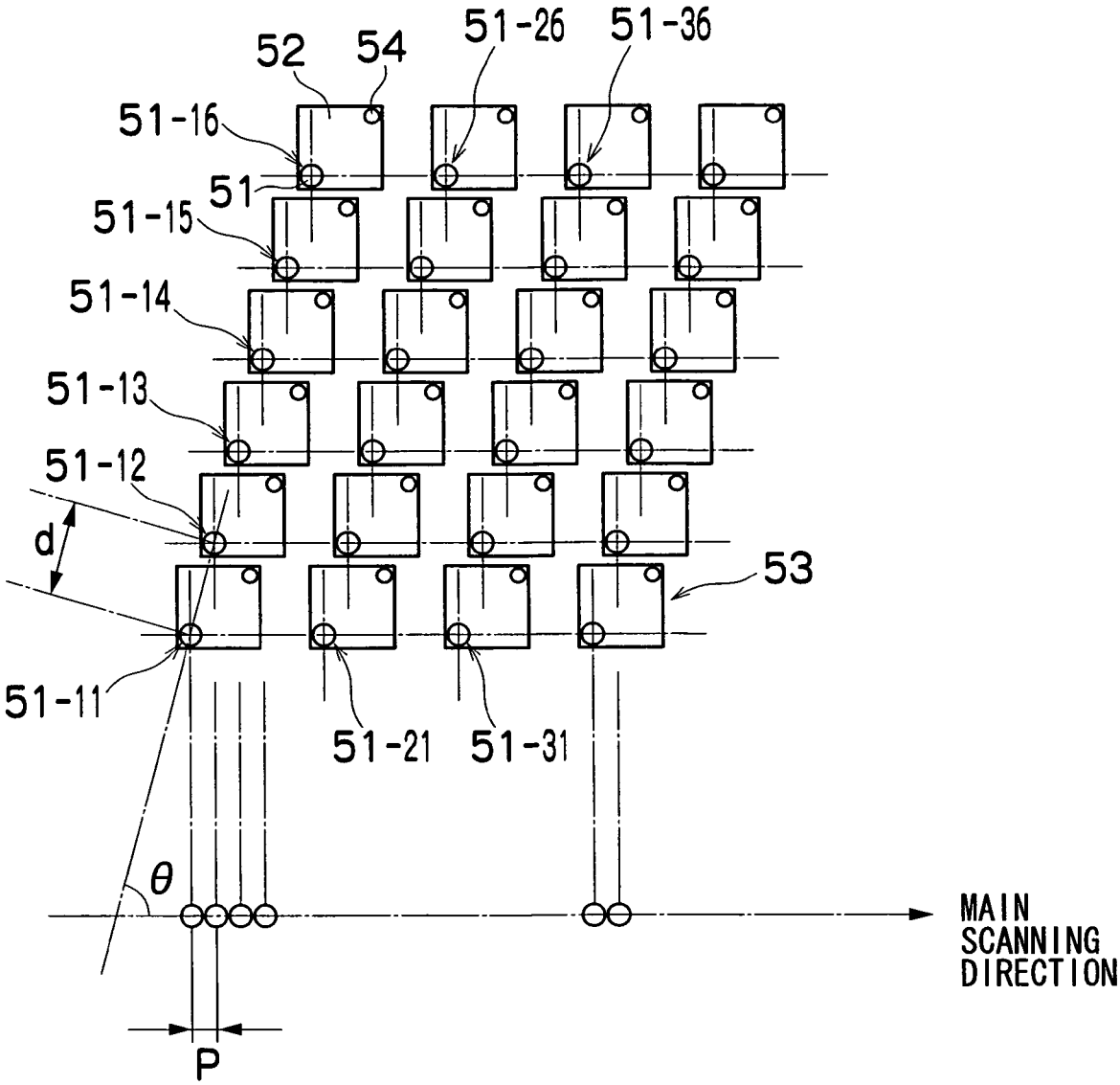
FIG. 5 is an enlarged view showing nozzle arrangement of the print head in FIG. 3A.

The plurality of ink chamber units 53 having such a structure shown in FIG. 4 are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi).

In a full-line head comprising rows of nozzles that have a length corresponding to the entire width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles

51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure of these bubbles.

Configuration of Ink Supply System

Figure 6:
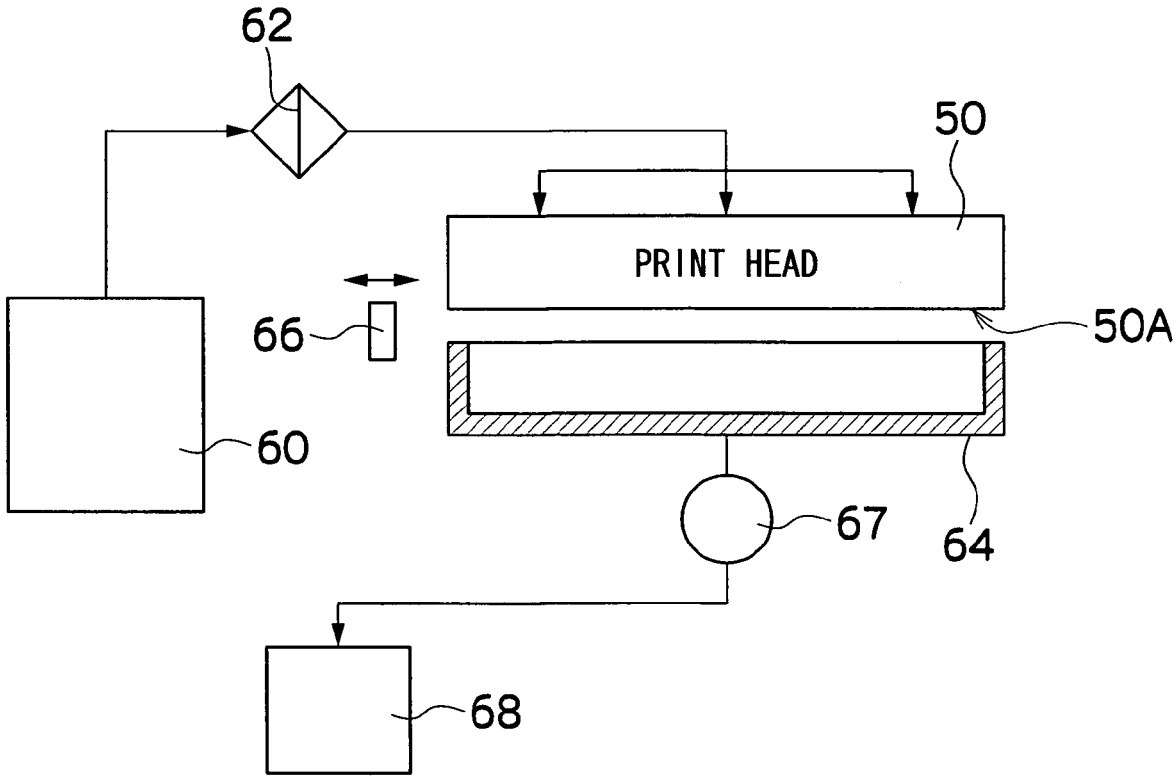
FIG. 6 is a schematic drawing showing a configuration of an ink supply system in the inkjet recording apparatus.

FIG. 6 is a schematic drawing showing the configuration of the ink supply system in the inkjet recording apparatus 10. An ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing/loading unit 14 in FIG. 1 described above.

A filter 62 for removing foreign matters and bubbles is disposed between the ink supply tank 60 and the print head 50, as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face 50A is thereby covered with the cap 64.

The cleaning blade 66 is composed of rubber or another elastic member, and can slide on the ink ejection surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary ejection is made toward the cap 64 to eject the degraded ink.

Also, when bubbles have become intermixed in the ink inside the print head 50 (inside the pressure chamber 53), the cap 64 is placed on the print head 50, ink (ink in which bubbles have become intermixed) inside the pressure chamber 52 is removed by suction with a suction pump 67, and the suction-removed ink is sent to a collection tank 68. This suction action entails the suctioning of degraded ink of which viscosity has increased (hardened) when initially loaded into the head, or when service has started after a long period of being stopped.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state the actuator 58 is operated (in a viscosity range that allows ejection by the operation of the actuator 58), and the preliminary ejection is made toward the ink receptor to which the ink of which viscosity has increased in the vicinity of the nozzle is to be ejected. After the nozzle surface 50A is cleaned by a wiper such as the cleaning blade 66 provided as the cleaning device for the nozzle face 50A, a preliminary ejection is also carried out in order to prevent the foreign matter from becoming mixed inside the nozzles 51 by the wiper sliding operation. The preliminary ejection is also referred to as "dummy ejection", "purge", "liquid ejection", and so on.

When bubbles have become intermixed in the nozzle 51 or the pressure chamber 53, or when the ink viscosity inside the nozzle 51 has increased over a certain level, ink can no longer be ejected by the preliminary ejection, and a suctioning action is carried out as follows.

More specifically, when bubbles have become intermixed in the ink inside the nozzle 51 and the pressure chamber 53, ink can no longer be ejected from the nozzles even if the actuator 58 is operated. Also, when the ink viscosity inside the nozzle 51 has increased over a certain level, ink can no longer be ejected from the nozzle 51 even if the actuator 58 is operated. In these cases, a suctioning device to remove the ink inside the pressure chamber 52 by suction with a suction pump, or the like, is placed on the nozzle face 50A of the print head 50, and the ink in which bubbles have become intermixed or the ink of which viscosity has increased is removed by suction.

However, this suction action is performed with respect to all the ink in the pressure chamber 53, so that the amount of ink consumption is considerable. Therefore, a preferred aspect is one in which a preliminary ejection is performed when the increase in the viscosity of the ink is small.

As described in detail below, in the present embodiment, ink of increased viscosity can be discharged by lowering the flow channel resistance of the nozzle 51, by generating gas bubbles through electrolysis.

Description of Control System

Figure 7:
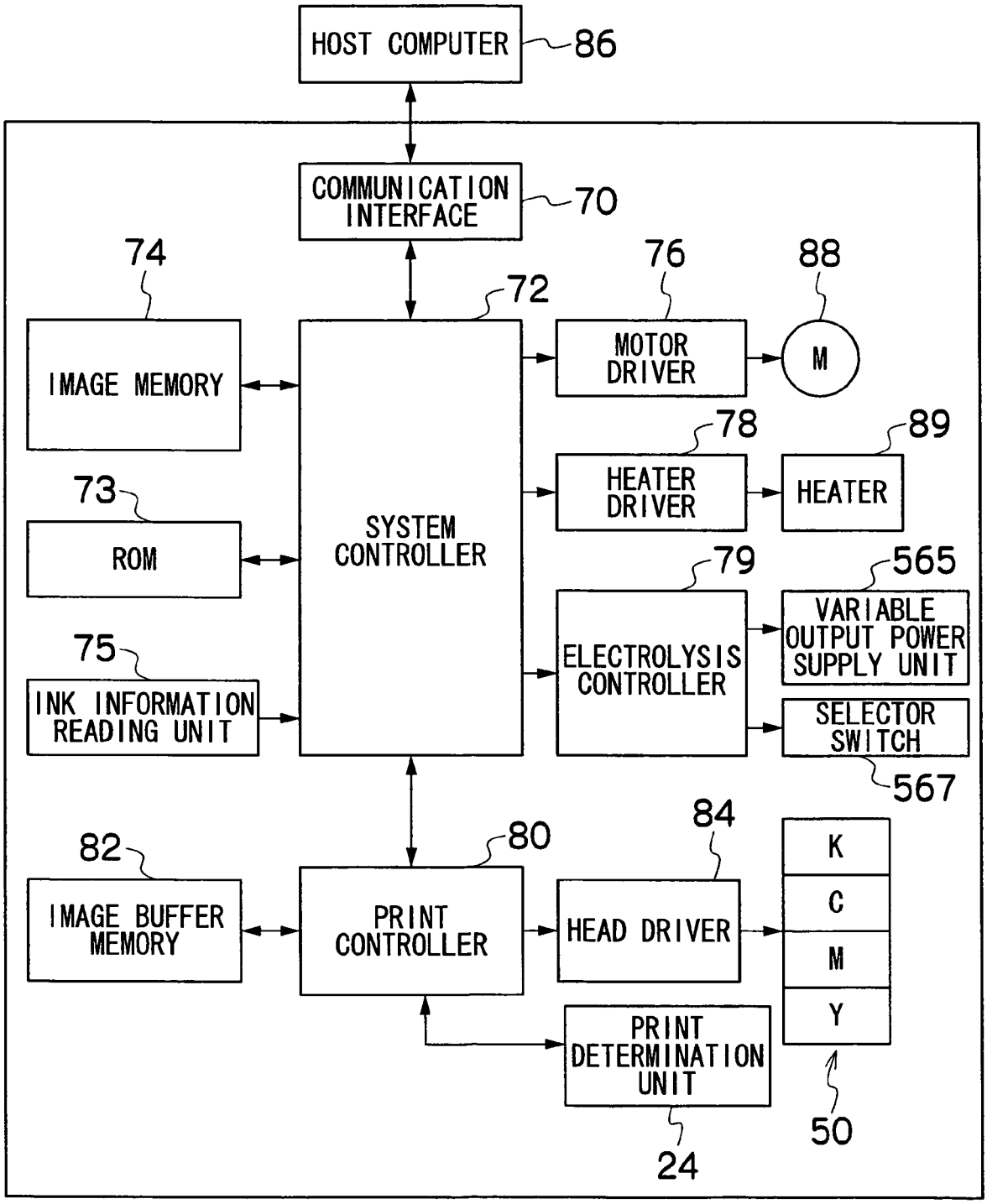
FIG. 7 is a block diagram of principal components showing a system configuration of the inkjet recording apparatus.

FIG. 7 is a block diagram of the principal components showing the system configuration of the inkjet recording apparatus 10. The inkjet recording apparatus 10 has a communication interface 70, a system controller 72, ROM 73, an image memory 74, an ink information reading unit 75, a motor driver 76, a heater driver 78, an electrolysis controller 79, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 functions as a control device for controlling the whole inkjet recording apparatus 10 in accordance with a prescribed program, and it also functions as a calculating device for performing various types of calculations. More specifically, the system controller 72 is constituted by a central processing unit (CPU), peripheral circuits relating to same, and the like. The system controller 72 controls respective units, such as the communications interface 70, ROM 73, image memory 74, motor driver 76, and the like, and it also controls communications with the host computer 86 and read and write operations to and from ROM 73, the image memory 74, and the like, as well as generating control signals for controlling the conveyance motor 88 and the heater 89.

The ROM 73 stores programs executed by the CPU of the system controller 72, various data required for control procedures, and the like. It is preferable that the ROM 73 is a non-rewriteable storage device, or a rewriteable storage device such as an EEPROM. The image memory 74 is used as a temporary storage region for image data, and it is also used as a program development region and a calculation work region for the CPU.

The ink information reading unit 75 is a device for reading in information relating to the ink type. More specifically, it is possible to use, for example, a device which reads in ink properties information from the shape of the cartridge in the ink tank 60 (a specific shape which allows the ink type to be identified), or from a bar code or IC chip incorporated into the cartridge. Besides this, it is also possible for an operator to input the required information by means of a user interface. Information obtained from the ink information reading unit 75 is sent to the system controller 72, and is used for electrolysis voltage control, discharge control, and the like.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

An electrolysis control unit 79 generates a control signal for controlling the output of the variable output power supply unit 565 in accordance with instructions from the system controller 72, and it also generates a control signal for switching the connection of the selector switch 567.

The variable output power supply unit 565 is constituted by a power supply circuit whose output voltage, pulse width and pulse frequency can be varied. The variable output power supply unit 565 generates an electrolysis voltage signal in accordance with the control signal from the electrolysis control unit 79. The variable output power supply unit 565 is able to generate at least two types of voltage signals, including a first voltage signal suitable for generating gas bubbles on the inner walls of the nozzle 51, and a second voltage signal suitable for generating gas bubbles in the restricting section of the supply flow channel 542. It is also possible to use the drive power source of the actuator 58, or another power supply, jointly, as a power source for generating an electrolysis voltage.

The print controller 80 is a control unit having a signal processing function for performing various treatment processes, corrections, and the like, in accordance with the control implemented by the system controller 72, in order to generate a signal for controlling printing, from the image data in the image memory 74, and it supplies the print control signal (image data) thus generated to the head driver 84. Prescribed signal processing is carried out in the print controller 80, and the discharge amount and the discharge timing of the ink droplets from the respective print heads 50 are controlled via the head drier 84, on the basis of the image data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 8 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58 (corresponding to the ejection drive device) for the print head 50 of each color on the basis of the print data received from the print controller 80. A feedback control system for keeping the drive conditions for the print heads constant may be included in the head driver 84.

The image data to be printed is externally inputted through the communications interface 70, and is stored in the image memory 74. At this stage, RGB image data is stored in the image memory 74.

The image data stored in the image memory 74 is sent to the print controller 80 through the system controller 72, and is converted to the dot data for each ink color by a known dithering algorithm, random dithering algorithm or another technique in the print controller 80. In other words, the print controller 80 performs processing for converting the input RGB image data into dot data for four colors, KCMY. The dot data generated by the print controller 80 is stored in the image buffer memory 82.

The head driver 84 generates drive control signals for the head 50 on the basis of the dot data stored in the image buffer memory 82. By supplying the drive control signals generated by the head driver 84 to the head 50, ink is discharged from the head 50. By controlling ink discharge from the head 50 in synchronization with the conveyance speed of the recording paper 16, an image is formed on the recording paper 16.

As shown in FIG. 1, the print determination unit 24 is a block including a line sensor, which reads in the image printed onto the recording paper 16, performs various signal processing operations, and the like, and determines the print situation (presence/absence of discharge, variation in droplet ejection, etc.), these determination results being supplied to the print controller 80.

According to requirements, the print controller 80 makes various corrections with respect to the head 50 on the basis of information obtained from the print determination unit 24. Furthermore, the system controller 72 implements control for carrying out preliminary discharge (including electrolysis), suctioning, and other prescribed restoring processes, on the basis of the information obtained from the print determination unit 24.

Action of the Gas Bubbles Generated by Electrolysis

Next, the function of generating gas bubbles by electrolysis in an inkjet recording apparatus 10 having the composition described above will be explained.

Figure 8A:
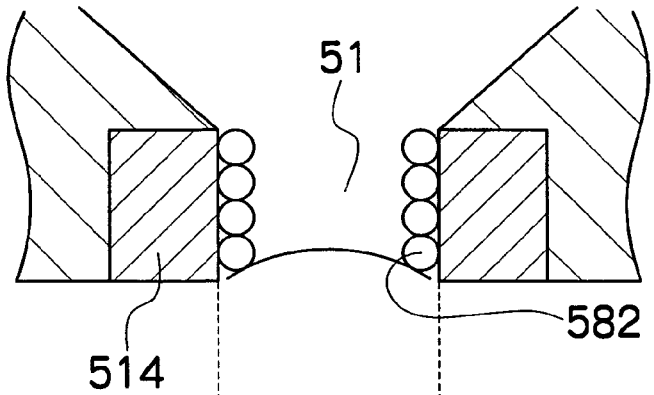
FIGS. 8A to 8C are diagrams used to describe the action of minute gas bubbles generated on the inner wall of a nozzle.

FIG. 8A is a schematic cross-sectional diagram showing an enlarged view of the meniscus section of a nozzle 51. By applying a prescribed pulse voltage between the first electrode 514 and the second electrode 544 (not illustrated in FIG. 8A), a plurality of minute gas bubbles 582 are generated in a densely packed fashion on the electrode surface on the inner wall of the nozzle 51. In other words, when a voltage is applied between the electrodes, bubbles 582 of hydrogen gas are generated from the boundary surface of the first electrode 514 which lies in contact with the ink, and these gas bubbles 582 adhere to the electrode surface in such a manner that they are not launched off into the surrounding ink. Desirably, the gas bubbles have a diameter of 10 μm or less, and more desirably, 5 μm or less.

Figure 8B:
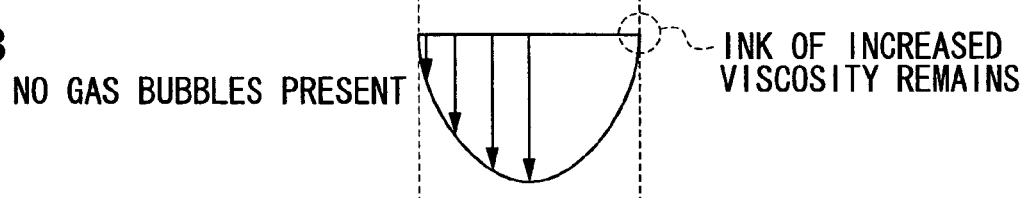
Figure 8C:
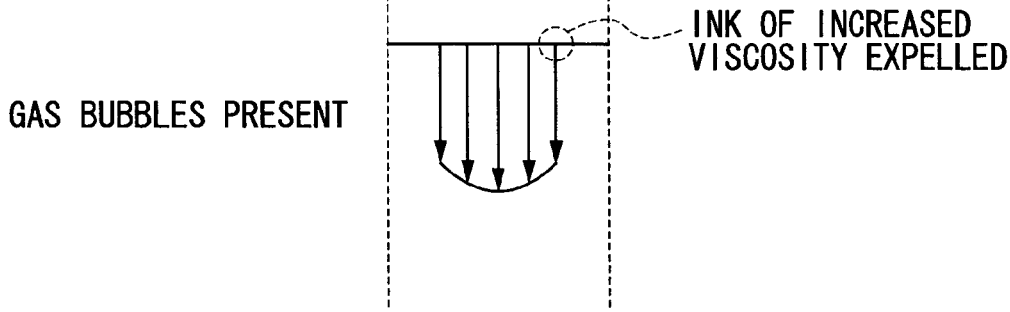

FIG. 8B is a diagram showing the flow velocity distribution in the nozzle 51 in a case where liquid is discharged from the nozzle 51 in a state where no electrolysis gas bubbles are adhering to the nozzle wall, and FIG. 8C is a diagram showing the flow velocity distribution in the nozzle 51 in a case where liquid is discharged from the nozzle 51 in a state where electrolysis gas bubbles are adhering to the nozzle wall. As shown in FIG. 8B, if there are no gas bubbles on the inner wall of the nozzle 51, then the ink inside the nozzle 51 makes contact with the inner wall of the nozzle 51 and the flow velocity of the ink is reduced in the vicinity of the inner wall due to the effects of frictional resistance. Therefore, if the ink has increased in viscosity, ink of increased viscosity will remain inside the nozzle 51, even if a discharge operation is performed by the actuator 58.

On the other hand, if minute gas bubbles 582 are generated on the inner wall of the nozzle 51 as shown in FIG. 8A, then the ink of increased viscosity in the vicinity of the inner wall is separated from the inner wall by the gas bubbles 582 generated from the boundary with the electrode surface. Therefore, the effect of the frictional resistance with the inner wall of the nozzle 51 is reduced, and ink of increased viscosity can be expelled readily.

As one mode of activating the gas bubble generation function, it is possible to restore discharge errors by performing preliminary discharge while generating gas bubbles on the inner wall of the nozzle 51 as shown in FIG. 8A, in cases where a discharge error has been determined by the print determination unit 24 or other discharge determination device. Furthermore, by generating gas bubbles during a maintenance operation (preliminary discharge) which is carried out at fixed or irregular intervals under prescribed conditions, it is possible to expel ink of increased viscosity, efficiently, during preliminary discharge.

Alternatively, gas bubbles can be generated during a normal printing operation, as well as during preliminary discharge, in such a manner that discharge is performed in the state illustrated in FIG. 8A.

However, in this case, the apparent nozzle diameter varies depending on whether or not gas bubbles are generated, as illustrated in FIGS. 8B and 8C, and therefore, it is desirable that discharge driving is controlled in accordance with the presence or absence of gas bubble generation, in such a manner that the discharge volume does not vary. Uniform discharge volume can be achieved by altering the drive voltage applied to the actuator 58 or altering the drive pulses.

Figure 9:
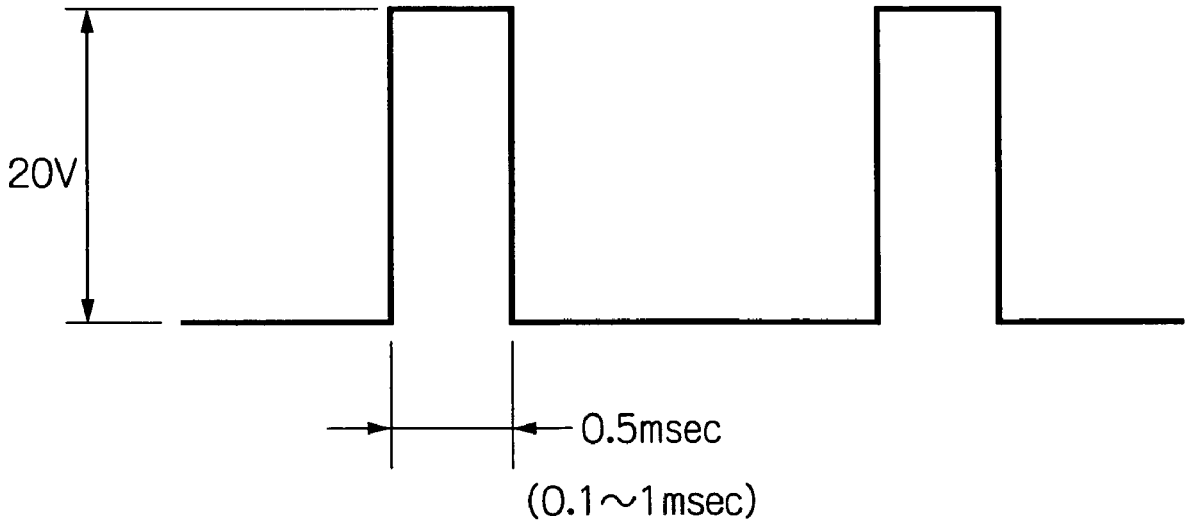
FIG. 9 is a waveform diagram showing one example of a voltage waveform for electrolysis applied when generating gas bubbles in the inner wall of the nozzle.

FIG. 9 is a waveform diagram showing one example of a voltage waveform applied to the first electrode pair. If the distance between the electrodes is 1 mm, then by setting the applied voltage to 20 V to 30V (shown as 20V in FIG. 9) at a pulse width of 0.1 msec to 1 msec (for example, 0.5 msec), it is possible to generate minute gas bubbles having a diameter of 5 μm or less, in a densely packed fashion, on the first electrode 514 which is connected to the negative pole. Furthermore, it is also possible to apply a plurality of pulses in the pulse waveform.

Since the ink forming the water-based electrolyte has an extremely small amount of dissolved hydrogen, then the hydrogen gas bubbles generated on the negative side disappear by dissolving into the ink within a time from several seconds to several tens seconds. Therefore, gas bubbles do not remain inside the head 50 for a long period of time so as to cause adverse effects on the discharge operation. On the other hand, the oxygen gas bubbles generated on the positive side (second electrode 544) are small in volume and since they are generated to the outside of the pressure chamber 52 (in the supply flow channel 542), then they have relatively little effect on discharge.

By using an ink with a reduced dissolved oxygen content (such as deaerated ink), it is possible to shorten the time taken for the oxygen gas bubbles to disappear. Therefore, a more desirable composition is one in which a deaerated ink of this kind is used.

Figure 10:
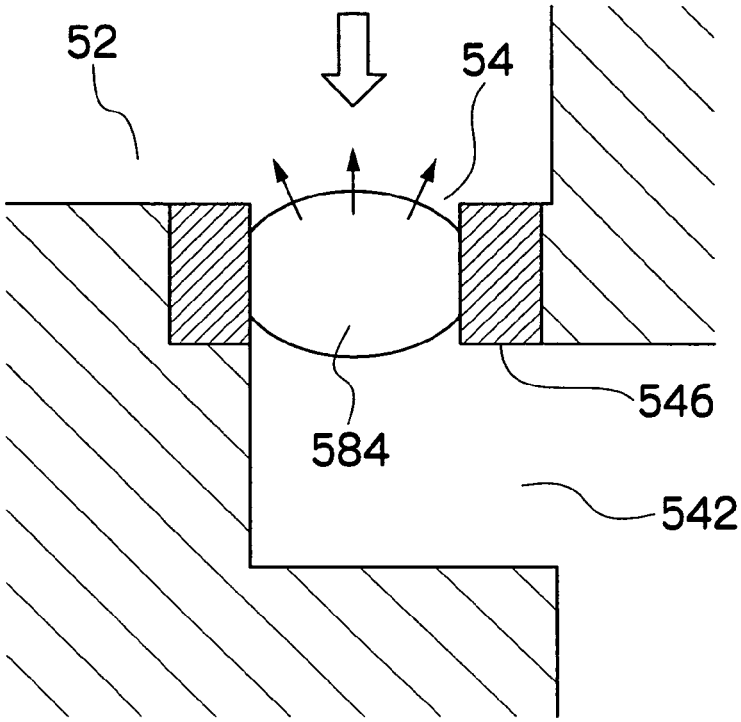
FIG. 10 is a principal cross-sectional view for describing the action of a gas bubble generated at a restricting section of a supply flow channel.

FIG. 10 is an enlarged view of the vicinity of the supply port 54 on which the third electrode 546 is formed. By switching the connection of the selector switch 527 illustrated in FIG. 4 and applying an electrolysis voltage between the third electrode 546 and the second electrode 544, a gas bubble 584 is generated on the inner walls of the supply flow channel 542, as illustrated in FIG. 10. This gas bubble 584 is formed to a size which completely blocks the supply flow channel 542. In order to generate a relatively large gas bubble of this kind by means of electrolysis, a voltage having a long pulse width and a low voltage level of approximately 3V, for example, is applied.

The ink inside the pressure chamber 52 seeks to move in the discharge direction (the direction of the nozzle) and the supply side direction (the direction of the supply flow channel 542 and the common flow channel 55) as a result of the movement of the actuator 58 during discharge, but since a gas bubble 584 sealing the supply flow channel 542 has been generated, as shown in FIG. 10, reflux toward the supply side is suppressed due to the surface tension at the boundary between the gas bubble 584 and the ink. In other words, the reflux resistance toward the supply side is increased. Therefore, movement of ink toward the discharge direction is promoted, and the pressure created by the actuator 58 can be used efficiently for discharge. Consequently, it is possible to expel ink of increased viscosity, readily, thereby preventing discharge errors.

Figure 11:
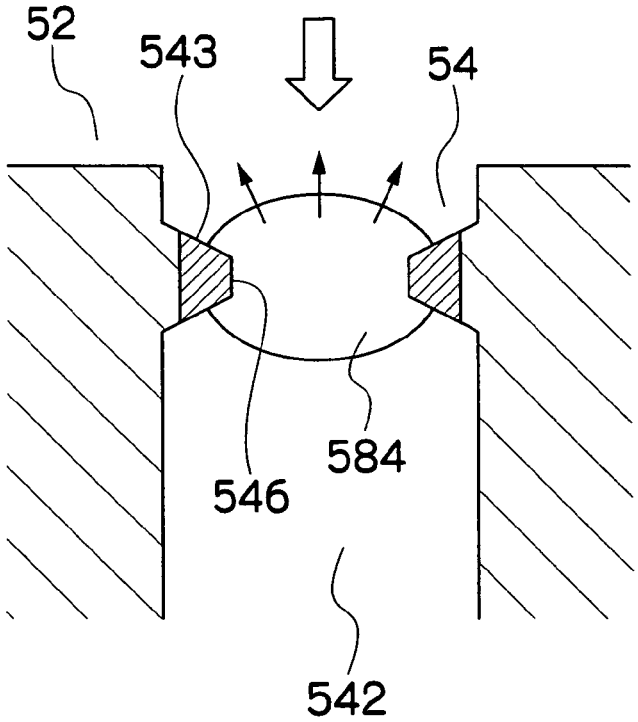
FIG. 11 is a principal cross-sectional diagram showing a further composition relating to a restricting section of a supply flow channel.

FIG. 11 is a diagram showing a modification example of FIG. 10. In FIG. 11, items which are the same as or similar to those in FIG. 10 are labeled with the same reference numerals and description thereof is omitted here. As shown in FIG. 11, a composition may be adopted in which a projection 543 is formed in the inner wall of the supply flow channel 542 and the third electrode 546 is formed on this projection 543 (the projection 543 may be formed by the actual electrode). The section where the cross-sectional surface area of the flow channel is reduced to a minimum by the projection 543 (namely, the point of maximum constriction) functions so as to restrict the supply to the pressure chamber 52. According to the example shown in FIG. 11, a gas bubble 584 can be retained readily at the point of maximum constriction, due to the shape of the projection 543.

In FIG. 11, a projection 543 is provided in the vicinity of the supply port 54, and the third electrode 546 is provided on the projection 543, but there is no particular limit on the position at which the projection 543 is formed (in other words, the position at which the third electrode 546 is formed), and the projection may be formed at a suitable position in the supply flow channel 542 which links the pressure chamber 52 with the common flow channel 55. Desirably, the third electrode 546 is formed upstream of the pressure chamber 52 in the region where the cross-sectional area of the flow channel is smallest.

Figure 12:
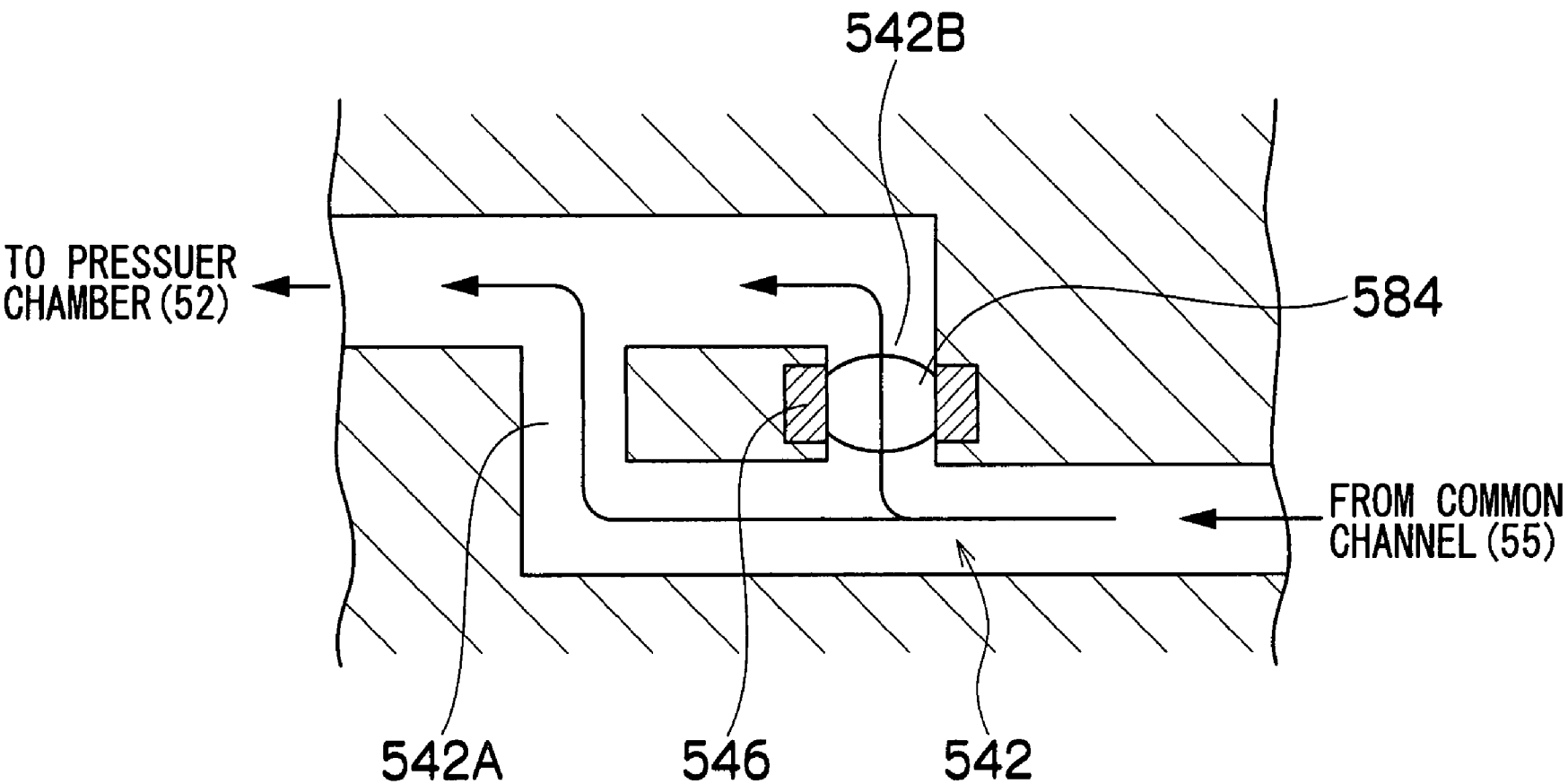
FIG. 12 is a principal cross-sectional diagram showing a further composition of a supply flow channel section.

FIG. 12 is a principal cross-sectional diagram showing a further composition of a supply flow channel 542 section which supplies ink from the common flow channel 55 to the pressure chamber 52. In FIG. 12, items which are the same as or similar to those in FIG. 4 are labeled with the same reference numerals and description thereof is omitted here. In the example shown in FIG. 12, a plurality of supply restricting flow channels 542A and 542B are formed in the supply flow channel 542 which links the respective pressure chamber 52 with the common flow channel 55, and an electrolysis electrode (third electrode 546) is formed in at least one of the supply restricting flow channels (in FIG. 12, the channel indicated by 542B).

By means of this composition, it is possible to control the reflux volume of ink during discharge, by sealing the supply restricting flow channel (indicated by 542B in FIG. 12), selectively, by controlling gas bubble generation. In FIG. 12, two supply restricting flow channels 542A and 542B are illustrated, but it is also possible to use a greater number of supply restricting flow channels. Furthermore, by disposing a third electrode 546 in all or a portion of the plurality of supply restricting flow channels and adopting a composition in which voltage can be applied selectively to these respective electrodes, it is possible to achieve yet finer control of the ink reflux volume during discharge, and refilling characteristics.

Modification Example

Figure 13:
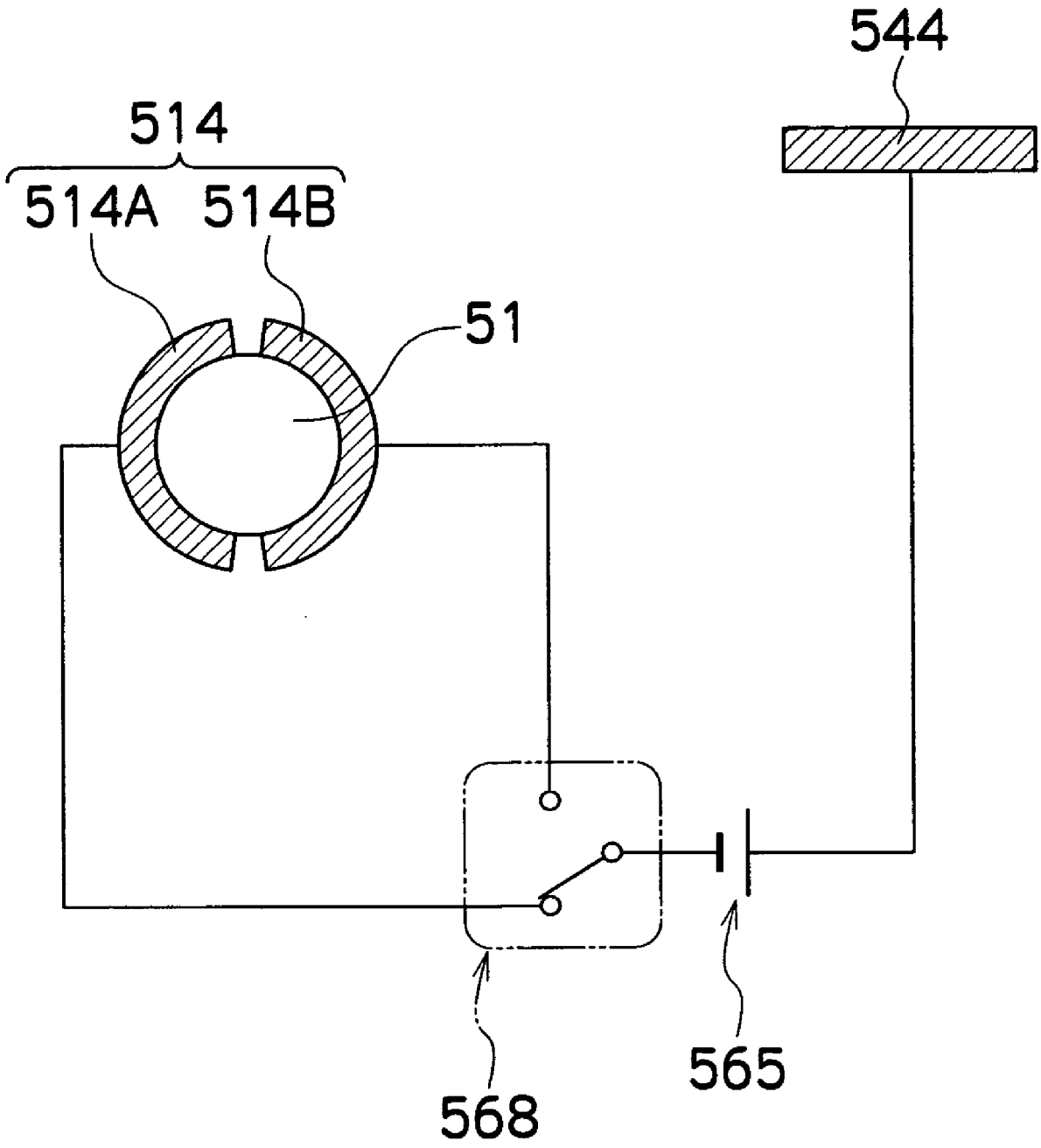
FIG. 13 is a schematic drawing showing an example of the arrangement of electrodes formed on the inner wall of a nozzle.

FIG. 13 is a schematic drawing showing an example of the composition of a first electrode 514 formed on the inner wall of a nozzle 51. In the example in FIG. 13, the first electrode 514 is split in the circumferential direction of the nozzle 51, in such a manner that voltage can be applied selectively to the resulting electrode sections 514A and 514B, by means of a selector switch 568. By changing the connection of the selector switch 568 shown in FIG. 13, by means of a control signal from the electrolysis control unit 79 illustrated in FIG. 7, for example, the electrode 514A or 514B to which voltage is applied can be changed.

Figure 14:
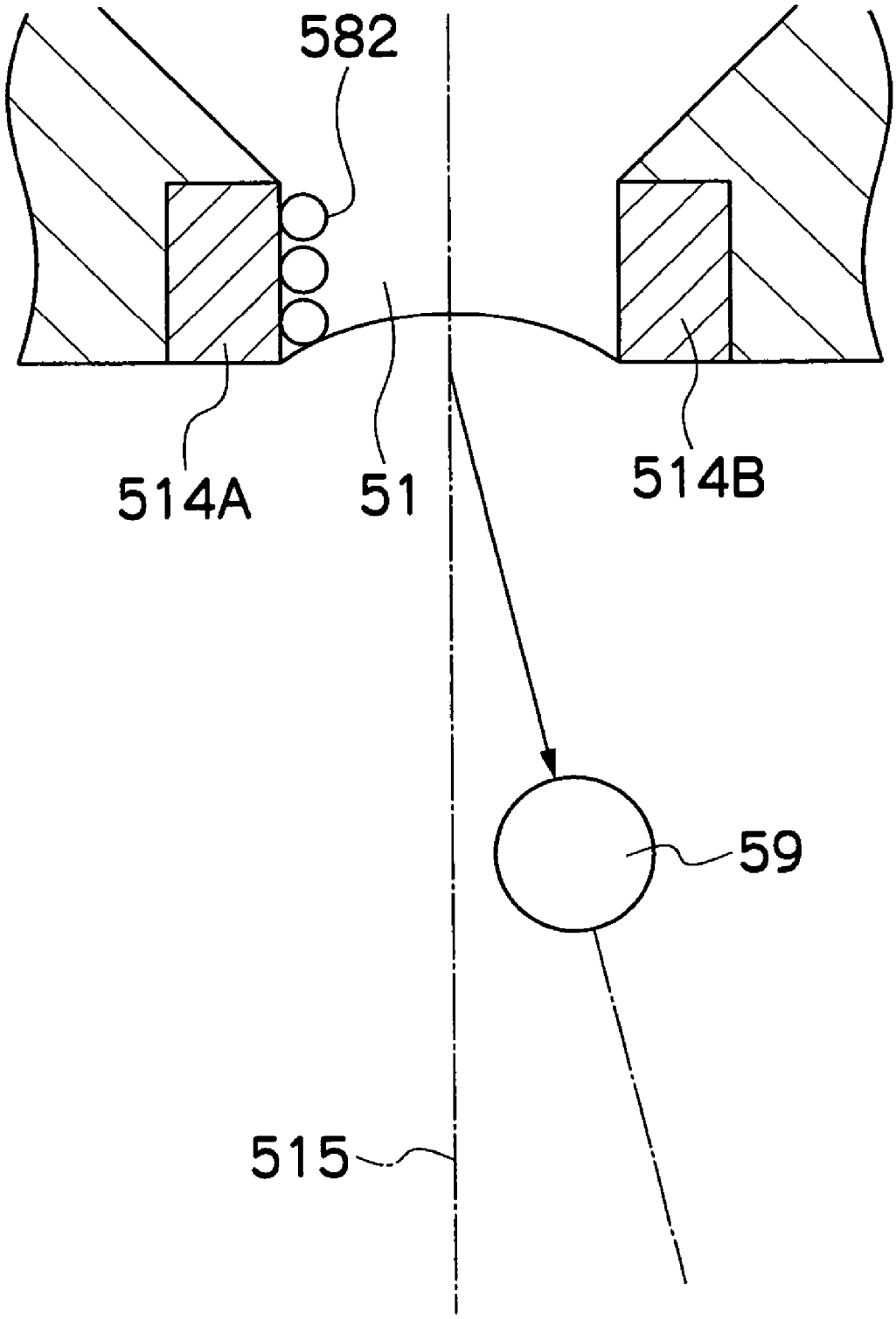
FIG. 14 is a principal schematic drawing for describing the action of the composition shown in FIG. 13.

FIG. 14 shows a situation where a voltage for electrolysis is applied to one of the electrode sections 514A. In this diagram, when a voltage is applied to the electrode section 514A situated on the left-hand side of the inner wall of the nozzle 51, gas bubbles 582 are generated on the corresponding electrode surface. In this case, no voltage is applied to the right-hand side electrode section 514B opposing the electrode section 514A, and therefore, no gas bubbles are formed thereon.

If discharge is performed by driving the actuator 58 (not illustrated in FIG. 14) in this state, then since the frictional resistance between the left-hand electrode section 514A and the ink is lower than the frictional resistance between the right-hand electrode section 514B and the ink, the symmetry of the flow velocity distribution is disturbed and an ink droplet 59 is discharged in an oblique direction which diverges from the central axis of the nozzle 515.

In this way, by controlling the position at which gas bubbles are generated inside the nozzle 51 (namely, by controlling the electrode section to which voltage is applied), it is possible to control the direction of flight of the ink droplet 59. The position at which the ink droplet 59 is deposited can be altered by using this function for deflecting the direction of flight.

FIG. 13 and FIG. 14 show an example where the first electrode 514 is split into two sections in the circumferential direction (namely, two sections of approximately 180° each), but in implementing the present invention, there is no particular limit on the number of splits in the electrode or the ratio between the sizes of the respective electrode sections, and therefore the mode of splitting the electrode (the arrangement of the split electrode sections) can be designed in accordance with the direction and angle in which the direction of flight is to be deflected.

Although not illustrated in FIG. 13, desirably, a circuit (control switch, or the like) is appended for switching the circuit on and off between the electrode sections 514A and 514B, in such a manner that voltage can be applied to both of the electrode sections 514A and 514B simultaneously, according to requirements. By appending a composition of this kind, it is also possible to achieve improved discharge efficiency as illustrated in FIGS. 4, 8 and 9.

Further Embodiments

Figure 15:
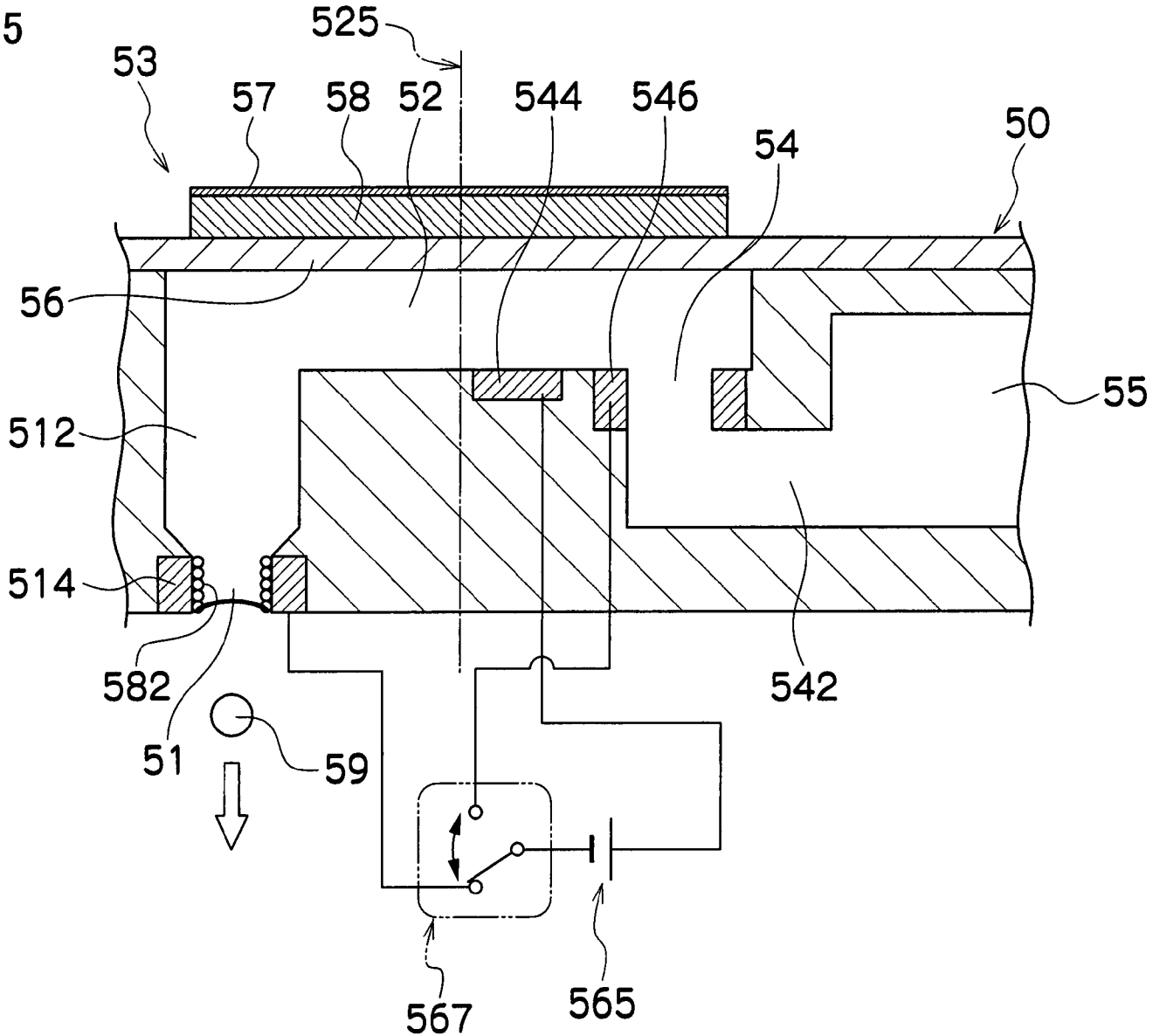
FIG. 15 is a cross-sectional diagram of a head according to a further embodiment of the present invention.

FIG. 15 shows a further embodiment of the present invention. In FIG. 15, items which are the same as or similar to those in FIG. 4 are labeled with the same reference numerals and description thereof is omitted here. The example shown in FIG. 15 differs from the composition in FIG. 4 in terms of the position at which the second electrode 544 is installed.

More specifically, the head 50 shown in FIG. 15 has a second electrode 544 provided inside the pressure chamber 52. In this case, taking into account the effects on discharge of the oxygen gas bubbles generated by the second electrode 544, desirably, the second electrode 544 is disposed in the position where it is least liable to affect discharge. For example, as shown in FIG. 15, desirably, the second electrode 544 is disposed in the region on the far side of the nozzle 51 with respect to the center line 525, which passes through the intermediate point between the position of the outlet port from the pressure chamber 52 to the nozzle 51 (the connection point of the nozzle connection channel 512) and the position of the supply port 54 (in order words, the second electrode 544 is disposed on side near to the supply port 54).

In the respective embodiments described above, an inkjet recording apparatus using a page-wide full line type head having a nozzle row of a length corresponding to the entire width of the recording medium has been described, but the scope of application of the present invention is not limited to this, and the present invention may also be applied to an inkjet recording apparatus using a shuttle head which performs image recording while moving a short recording head reciprocally.

One example of an image forming apparatus, but the scope of application of the present invention is not limited to this. For example, the liquid droplet discharge head according to the present invention may also be applied to a photographic image forming apparatus in which developing solution is applied to a printing paper by means of a non-contact method. Furthermore, the scope of application of the liquid droplet discharge head according to the present invention is not limited to an image forming apparatus, and the present invention may also be applied to various other types of apparatuses which discharge a processing liquid, or other liquid, toward a discharge receiving medium by means of a discharge head (such as a coating device, wiring pattern printing device, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet discharge head, comprising:

a liquid chamber flow channel which is filled with a liquid including an electrolytic liquid;

a supply flow channel which branches from the liquid chamber flow channel;

a pressure chamber which is connected to the supply flow channel and filled with the liquid supplied from the liquid chamber flow channel via the supply flow channel;

a pressure generating device which is provided to correspond to the pressure chamber and pressurizes the liquid inside the pressure chamber;

a nozzle which is connected to the pressure chamber and discharges a droplet of the liquid; and an electrolysis electrode which is formed on an inner wall of the nozzle in order to generate gas bubbles which reduce a flow channel resistance of the inner wall of the nozzle, wherein the electrolysis electrode generates, on the inner wall of the nozzle, minute gas bubbles which reduce the flow channel resistance of the inner wall of the nozzle when the pressure generating device pressurizes the liquid inside the pressure chamber in such a manner that the liquid flows in the nozzle.

2. The liquid droplet discharge head as defined in claim 1, further comprising another electrolysis electrode constituting a pair with the electrolysis electrode formed on the inner wall of the nozzle, the other electrolysis electrode being provided on one of an inner wall of the supply flow channel and an inner wall of the pressure chamber.

3. The liquid droplet discharge heads as defined in claim 1, wherein the electrolysis electrode formed on the inner wall of the nozzle is split into a plurality of electrode sections in a circumferential direction of the nozzle, and a voltage is applied selectively to each of the respective electrode sections.

4. A liquid droplet discharge device, comprising:

the liquid droplet discharge head as defined in claim 1;

a discharge control device which controls a driving of the pressure generating device; and an electrolysis signal generating device which generates a voltage signal for application to the electrolysis electrode.

5. The liquid droplet discharge device as defined in claim 4, wherein the electrolysis signal generating device generates a voltage signal whereby a diameter of the gas bubbles formed on the inner wall of the nozzle is not more than 10 μm.

6. An image forming apparatus, comprising:

the liquid droplet discharge device as defined in claim 4, wherein an image is formed on a recording medium by means of liquid droplets discharged from the nozzles.

7. A liquid droplet discharge head, comprising:

a liquid chamber flow channel which is filled with a liquid including an electrolytic liquid;

a supply flow channel which branches from the liquid chamber flow channel;

a pressure chamber which is connected to the supply flow channel and filled with the liquid supplied from the liquid chamber flow channel via the supply flow channel;

a pressure generating device which is provided to correspond to the pressure chamber and pressurizes the liquid inside the pressure chamber;

a nozzle which is connected to the pressure chamber and discharges a droplet of the liquid; and an electrolysis electrode which is formed on an inner wall of a restricting section of the supply flow channel in order to generate gas bubbles which impede a liquid flow on the inner wall of the restricting section of the supply flow channel, wherein the electrolysis electrode generates, at the restricting section, the gas bubbles that have size such that the gas bubbles impede a flow of the liquid inside the pressure chamber toward the supply flow channel during a discharge operation in which the pressure generating device pressurizes the liquid inside the pressure chamber in such a manner that the droplet of the liquid is discharged from the nozzle.

8. The liquid droplet discharge head as defined in claim 7, further comprising another electrolysis electrode constituting a pair with the electrolysis electrode formed on the inner wall of the restricting section of the supply flow channel, the other electrolysis electrode being provided on one of an inner wall of another portion of the supply flow channel and an inner wall of the pressure chamber.

9. The liquid droplet discharge head as defined in claim 7, wherein a plurality of supply flow channels are formed with respect to one pressure chamber, and the electrolysis electrode for generating gas bubbles which impede the flow of liquid is provided on the inner wall of at least one of the plurality of supply flow channels.

10. The liquid droplet discharge head as defined in claim 7, wherein an electrolysis electrode which is formed on an inner wall of the nozzle in order to generate gas bubbles which reduce a flow channel resistance of the inner wall of the nozzle.

11. A liquid droplet discharge device, comprising:

the liquid droplet discharge head as defined in claim 10;

a discharge control device which controls a driving of the pressure generating device;

an electrolysis signal generating device which generates a first voltage signal applied to the electrolysis electrode formed on the inner wall of the nozzle and a second voltage signal applied to the electrolysis electrode formed on the inner wall of the restricting section of the supply flow channel; and a switching device which applies each of the first voltage signal and the second voltage signal generated by the electrolysis signal generating device selectively to a corresponding one of the electrolysis electrodes.

12. A liquid droplet discharge device, comprising:

the liquid droplet discharge head as defined in claim 7;

a discharge control device which controls a driving of the pressure generating device; and an electrolysis signal generating device which generates a voltage signal for application to the electrolysis electrode.

13. The liquid droplet discharge device as defined in claim 12, wherein the electrolysis signal generating device generates a voltage signal for generating the gas bubbles which close the restricting section of the supply flow channel.

14. An image forming apparatus, comprising:

the liquid droplet discharge device as defined in claim 12, wherein an image is formed on a recording medium by means of liquid droplets discharged from the nozzles.

* * * * *